US007438364B2

(12) United States Patent
Boehme et al.

(10) Patent No.: US 7,438,364 B2
(45) Date of Patent: Oct. 21, 2008

(54) SCRAPER DEVICE FOR MILLING DRUMS OF A CONSTRUCTION MACHINE

(75) Inventors: Heiko Boehme, Vettelschoss (DE); Herbert Ley, St. Katharinen (DE); Urban Kurscheid, Koenigswinter (DE); Guenter Tewes, Unkel/Rhein (DE)

(73) Assignee: Wirtgen GmbH, Windhagen (DE)

( * ) Notice: Subject to any disclaimer, the term of this patent is extended or adjusted under 35 U.S.C. 154(b) by 124 days.

(21) Appl. No.: 11/633,511

(22) Filed: Dec. 5, 2006

(65) Prior Publication Data

US 2007/0127986 A1 Jun. 7, 2007

(30) Foreign Application Priority Data

Dec. 5, 2005 (DE) ..... 10 2005 058 102

(51) Int. Cl.
*E01C 23/088* (2006.01)

(52) U.S. Cl. ..... 299/39.4

(58) Field of Classification Search ..... 299/36.1, 299/39.2, 39.4; 404/90
See application file for complete search history.

(56) References Cited

U.S. PATENT DOCUMENTS 4,325,580 A * 4/1982 Swisher et al. ..... 299/39.8
6,923,508 B2 * 8/2005 Holl et al. ..... 299/39.4

* cited by examiner

*Primary Examiner*—John Kreck
(74) *Attorney, Agent, or Firm*—Diller, Ramik & Wight

(57) ABSTRACT

In a scraper device for a milling drum (2) mounted in a construction machine, with a scraper blade (10) arranged in a height-adjustable manner behind the milling drum (2) when seen in the direction of travel, which can glide on the surface (3) milled or to be milled by the milling drum (2), where the scraper blade (10) is guided in lateral guides (12) in a height-adjustable manner relative to the milling drum (2), and where first centering devices (14) are provided which center the scraper blade (10) between the guides (12) with small lateral play of movement when in a raised position, and which allow a greater lateral play of movement of the scraper blade (10) when the scraper blade (10) is in a lowered working position, it is provided that the second centering devices (20) act upon the upper end (16) of the scraper blade (10), restricting the lateral displacement of the scraper blade (10) at the upper end (16) in case of a lateral movement of the scraper blade (10) in the guides (12).

17 Claims, 4 Drawing Sheets

SCRAPER DEVICE FOR MILLING DRUMS OF A CONSTRUCTION MACHINE

BACKGROUND OF THE INVENTION

The invention relates to a scraper device for a milling drum mounted in a construction machine.

Such a scraper device is known, for instance, from DE 102 47 579.

The scraper device for milling drums of a construction machine described therein, in particular of a road milling machine wherein milling drums of different milling widths can be used within a maximum milling width, consists of a scraper blade that can glide on the surface milled or to be milled by the milling drum.

The scraper blade is required to scrape milled material, which accumulates behind the milling drum when seen in the direction of travel, from the milled surface in order to leave behind a thoroughly clean milled area. When doing so, the material that has accumulated behind the milling drum is fed to the milling drum once again until it is accepted and transported away by a transport device.

Previously known centering devices which consist, for example, of cams projecting laterally from the scraper blade, which engage with lateral guides of the scraper blade and restrict the lateral play of the scraper blade in the engagement position of these cams, have not been capable of preventing jamming. In the working position of the milling drum at maximum milling depth, the cams are not engaged with the lateral guides, thus permitting an increased lateral play of the scraper blade. This increased lateral play is required in the operating mode of the milling machine so as to enable unobstructed driving through bends during the milling operation. The milling drum can be set to different milling depths. When doing so, the scraper blade always has the same working position, in which the lower edge of the scraper blade is at the same height as the lowest portion of the cutting circle of the milling drum.

However, if the milling operation has to be interrupted due to, for instance, the replacement of tools, and the milling machine with the milling drum must dive into an existing cut, then it is very difficult for the machine operator to also lower the scraper blade into the previously milled track if the permitted lateral play is too large. If the scraper blade does not enter the existing milled cut due to the lateral play but hits the still untreated road surface with one side instead, then the scraper blade jams, and a high amount of effort is required to disengage a scraper blade that is jammed in this way. Frequently, several attempts are necessary to lower the scraper blade in the correct position, or the machine operator commences the milling operation without the scraper blade entering the milled track. Milled material then remains in the milled track, in which case there is the additional hazard of persons being injured by milled material that is thrown out through the unclosed opening of the drum housing.

Hence, the purpose of the invention is to further develop a scraper device of the type first above mentioned in such a manner that jamming of the scraper blade is prevented.

BRIEF SUMMARY OF THE INVENTION

The invention provides in an advantageous manner that second centering devices act upon the upper end of the scraper blade, restricting the lateral displacement of the scraper blade at the upper end in case of lateral movement of the scraper blade in the guides.

In this way, jamming of the scraper blade is safely prevented if one side of the scraper blade touches the ground outside of the milled track. The time-consuming disengagement of a jammed scraper blade is thus eliminated, and the second centering device is useful for additionally centering the position of the scraper blade when the scraper blade is in raised position so that it will be easier for the machine operator to find the previously milled track when lowering the scraper blade, provided that the milling machine is generally aligned in a correct manner.

The second centering devices, arranged on the scraper blade at a distance from the first centering devices, restrict the tilting movement of the scraper blade when the scraper blade meets with a one-sided obstacle.

The restriction of the lateral displacement of the scraper blade effectively prevents jamming of the scraper blade so that the movability of the scraper blade is maintained even when the scraper blade cannot be lowered centrically into an existing milled track.

It is preferably provided that the second centering devices show a groove which runs parallel to the guides as well as an engagement element which interacts with the groove. The interaction between the engagement element and the groove allows a pre-determined play to be adhered to, whereby the width of the groove may be widened along its length, in particular towards the lower end.

The second centering devices consist, for example, of an engagement element that projects from the scraper blade and engages with the groove that runs parallel to the lateral guides.

The play between the groove and the engagement element may increase towards the lower end of the groove in order to allow an increased lateral play in the lowered position of the scraper blade in accordance with the increased lateral play of the first centering devices so as to enable unobstructed driving through bends in operating mode.

When doing so, the play between the groove and the engagement element may increase continuously towards the lower end of the groove.

Alternatively, the engagement element may engage with a widened groove in the lowered working position of the scraper blade.

The second centering devices can be arranged in the central axis of the scraper blade that runs parallel to the guides or at a parallel distance to the same.

The second centering devices consist of several elements, where one element of the second centering devices is preferably arranged on a projection which projects upwards from the scraper blade.

The distance in height of the second centering devices from the first centering devices can be increased by means of the projection. The second centering devices can show a sliding block as an engagement element which is attached to the upper end of the scraper blade and is guided inside the groove. The groove is located in a housing part of the drum housing of the milling drum or in a machine element connected to the machine frame such as, for example, a portal. By means of the sliding block in the grooved guide, the point of the center of tilt of the scraper blade can be restricted laterally if the scraper blade meets with an obstacle on one side so as to effectively prevent jamming of the scraper blade.

The distance between the element of the second centering devices arranged at the scraper blade and the first centering devices as measured in the direction of the lateral guide is more than 50% of the length of the scraper blade in height to maximum the length of the scraper blade minus 50% of the maximum milling depth of the milling drum.

The first centering devices consist of cams arranged at a distance from the lower edge of the scraper blade, which reduce the play between the scraper blade and the lateral guides.

The distance of the cams arranged at the scraper blade from the lower edge of the scraper blade is smaller than the maximum milling depth of the milling drum.

The sliding block as engagement element shows rounded lateral surfaces that interact with the groove walls of the groove.

The sliding block as engagement element shows diagonal guide surfaces on its top side which interact with the groove walls of the groove in the narrowing section.

When in the engagement position with the smaller play of movement, the second centering devices preferably allow a smaller play of movement than the first centering devices.

When the scraper blade is being raised, the second centering devices preferably reach the engagement position with the smaller play of movement first.

In the following, an embodiment of the invention is explained in more detail with reference to the drawings:

DETAILED DESCRIPTION OF THE INVENTION

Figure 1:
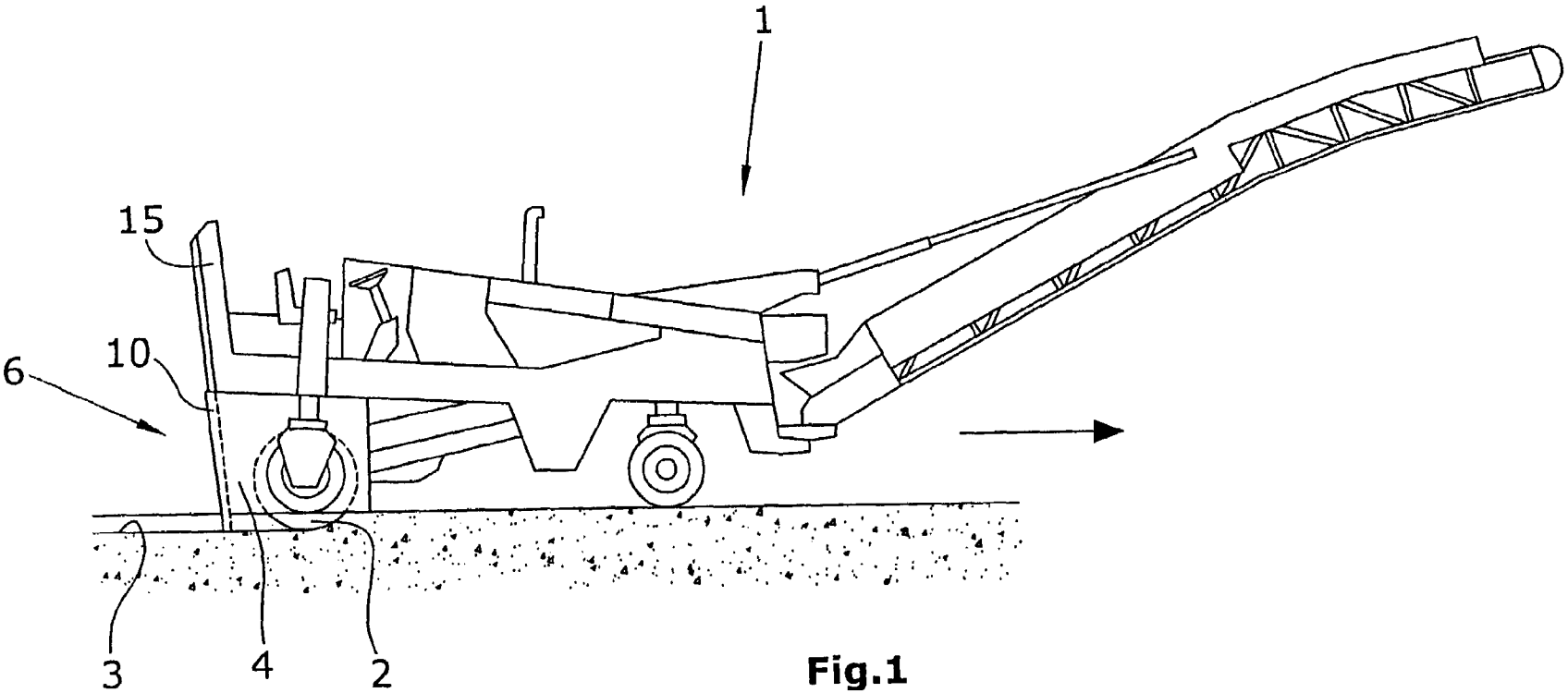
FIG. 1 a front-loading road milling machine in accordance with the invention.
Figure 2:
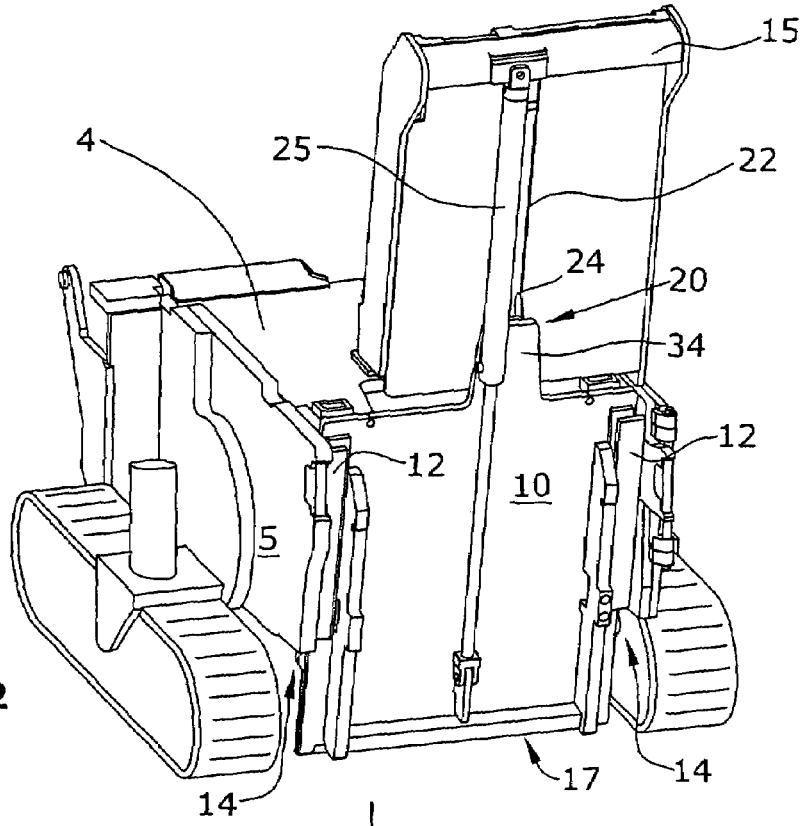
FIG. 2 a perspective view of the scraper device in accordance with the invention, behind a milling drum.

FIG. 1 shows the use of the invention in a front-loading road milling machine. The automotive road milling machine 1 shown in FIG. 1 is equipped with wheels, but can, of course, also be borne by crawler track units as they are depicted in FIG. 2. In the embodiment of the road milling machine 1 in accordance with FIG. 1, the milling drum 2 is arranged at the rear end of the machine and is enclosed by a drum housing 4.

A scraper device 6 with a portal 15 and a piston cylinder unit 25 is arranged at the rear end of the drum housing 4 when seen in the direction of travel, the said scraper device 6 showing a height-adjustable scraper blade 10 which covers the milling width of the milling drum 2 and is guided in a height-adjustable manner, for example, in the portal 15 attached to the machine frame 5 by means of the piston cylinder unit 25.

The scraper blade 10 is guided in lateral guides 12 of the machine frame 5, whereby it has to be made clear that the machine element designated as 5 in FIG. 2 can also be the drum housing 4 attached to a machine frame.

The guides 12 run orthogonal to the rotating axis of the milling drum 2 when seen in the direction of travel.

Figure 3:
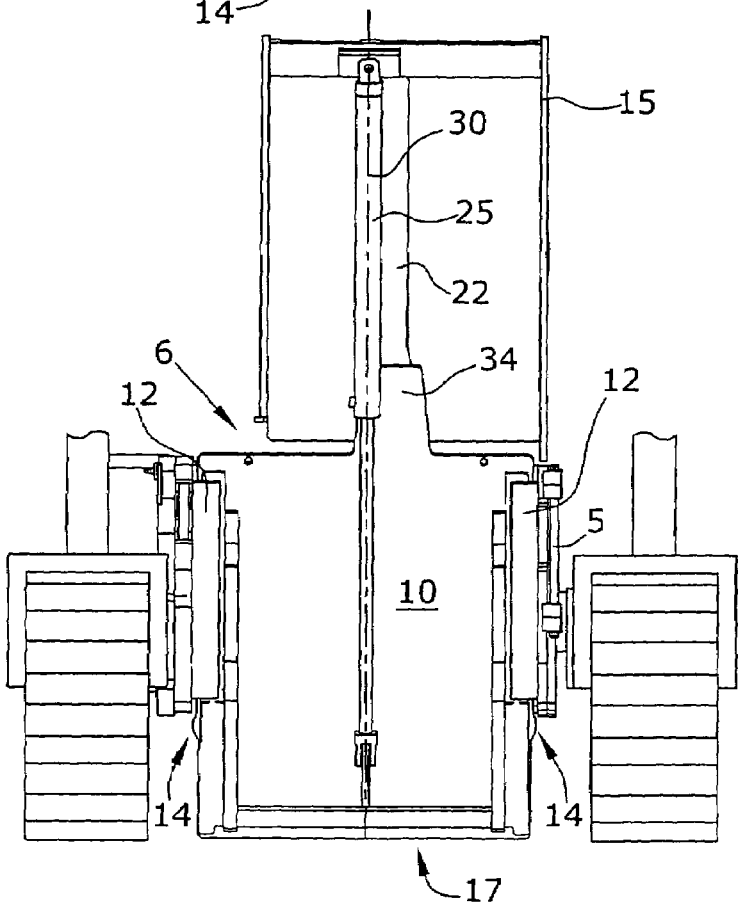
FIG. 3 a rear view of the scraper device in accordance with the invention.

The piston cylinder unit 25 engages at the upper edge of the portal 15 on the one hand and at a reinforced strip near the lower edge 17 of the scraper blade 10 on the other hand. As can be seen from FIG. 3, the piston cylinder unit 25 is preferably arranged in the central axis 30 of the scraper blade 10.

Figure 4:
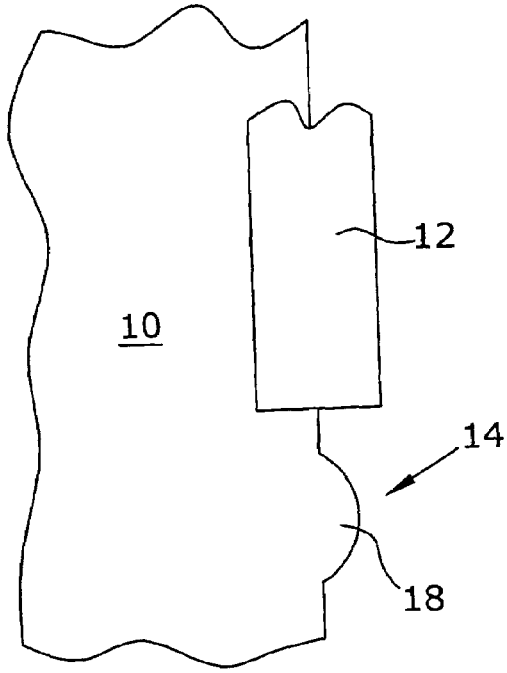
FIG. 4 a first centering device of the scraper blade.
Figure 5:
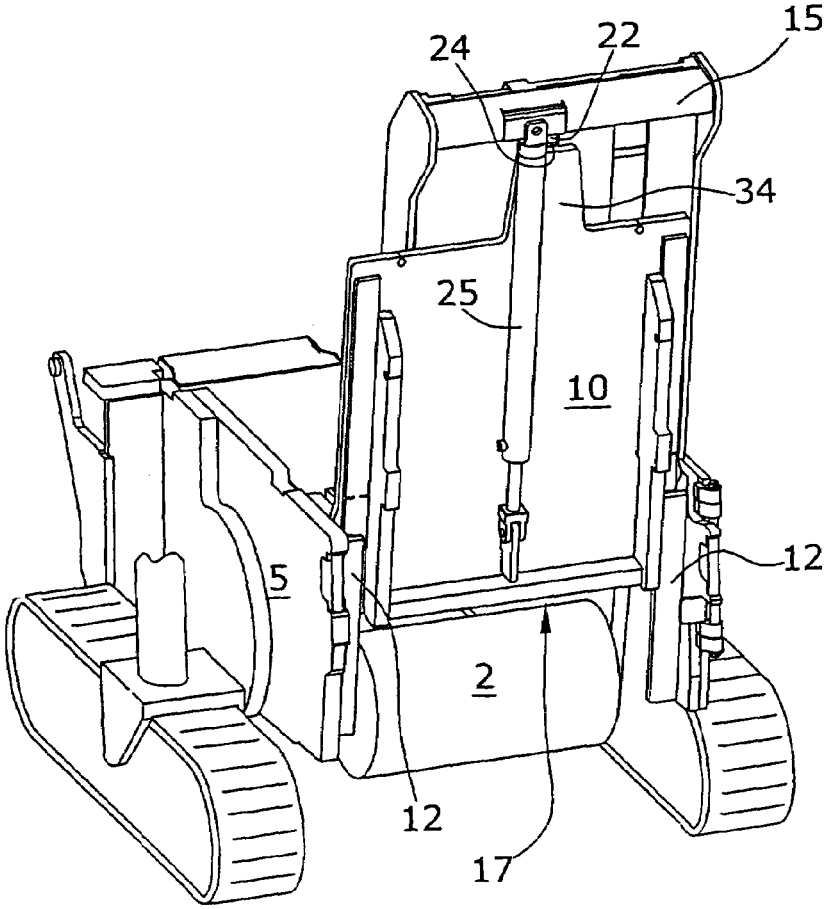
FIG. 5 the scraper device in raised position.

In its lower third, the scraper blade 10 shows first centering devices 14 which, as can best be seen from FIG. 4, consist of laterally projecting cams 18 that ensure a smaller lateral play of the scraper blade when engaging with the lateral guides 12.

The distance of the cams 18 from the lower edge of the scraper blade 10 is smaller than the maximum milling depth of the milling drum 2. This means that in the case of the maximum milling depth the lateral cams 18 are not engaged with the guides 12 so that a larger play is permitted for driving through bends. It is understood that the distance of the cams 18 from the lower edge 17 of the scraper blade can be adapted to the practical requirements and may therefore show a smaller distance, e.g. 50 to 90% of the maximum milling depth. The working position of the scraper blade is adapted to the cutting depth of the milling drum at any given milling depth, so that the lower edge of the scraper blade scrapes on the milled surface.

The second centering devices 20 consist of an engagement element 24 which projects from the scraper blade 10 and engages with a groove 22 that runs parallel to the guides 12 and is arranged in the portal 15. The engagement element 24 consists of a sliding block as it is depicted sectionally in FIG. 8 or 9 and which is attached at a projection 34 of the scraper blade 10 on the side facing the milling drum 2.

Figure 6:
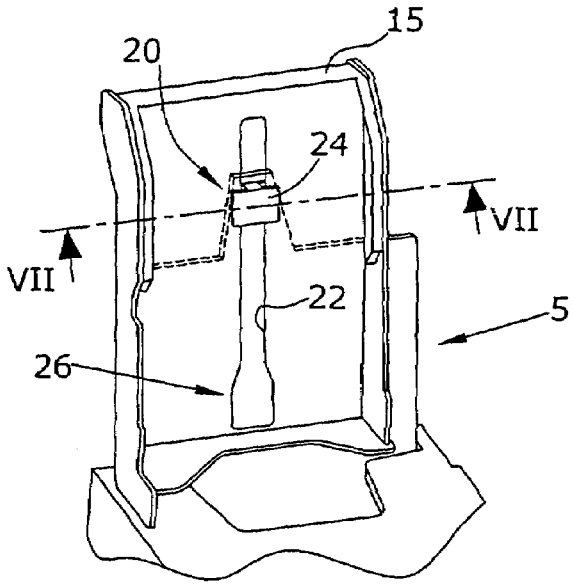
FIG. 6 a front view of the second centering devices.
Figure 7:
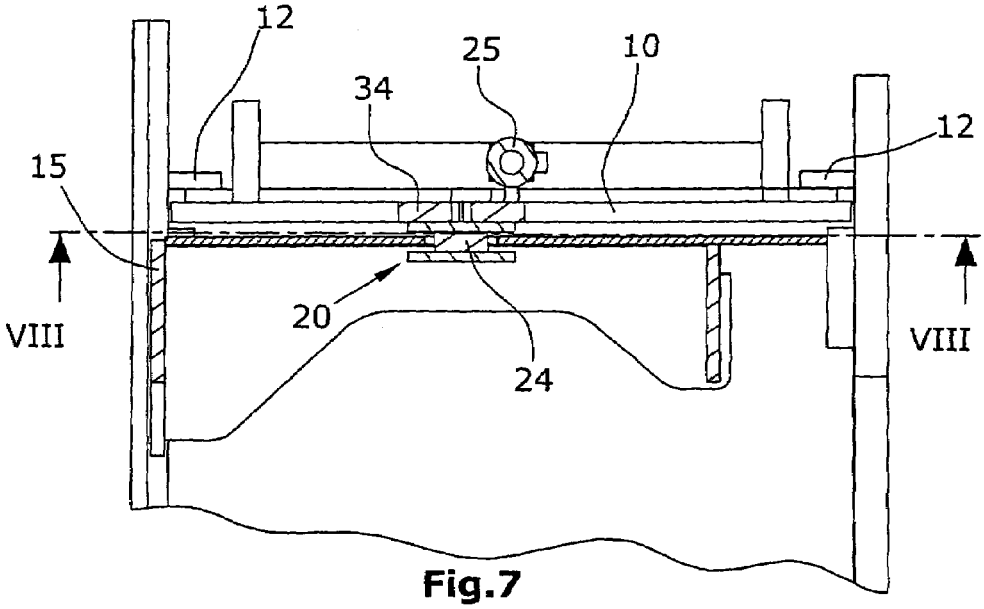
FIG. 7 a section along the line VII-VII in FIG. 6.

The shape of the groove 22 can best be seen from FIG. 6. An extension in width is provided at the lower end of the groove 22 so that, when the scraper blade 10 is in a lowered position, the second centering devices 20 will also permit an increased lateral play for driving through bends.

Figure 8:
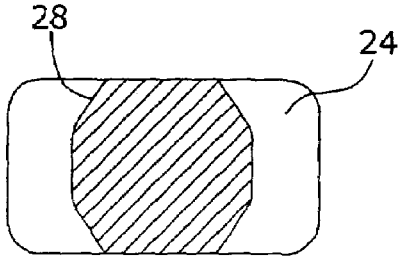
FIG. 8 a section along the line VIII-VIII in FIG. 7.
Figure 9:
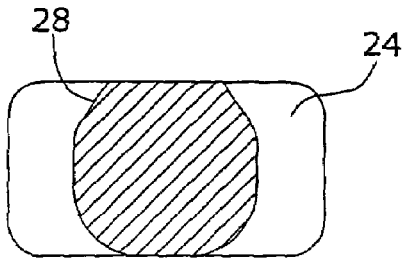
FIG. 9 an alternative embodiment of a sliding block.

As can best be seen from FIGS. 8 and 9, the sliding block serving as engagement element 24 shows guide surfaces 28 that co-operate with the tapered narrowing of the groove 22 when the scraper blade 10 is raised, so that the scraper blade 10 is centered by the tapered narrowing of the groove 22 and the guide surfaces 28 when being raised.

FIG. 9 shows a second embodiment of the sliding block, the central area of which shows circular-shaped rounded guide surfaces at the bottom.

Should the scraper blade 10 miss a previously existing milled track when being lowered and touch the ground with one side of the lower edge 17, then the second centering devices 20 reliably prevent an excessive tilting movement of the scraper blade 10 between the guides 12 so that the scraper blade 10 cannot jam in the lateral guides 12.

It is preferably provided that, when in the engagement position with the smaller play of movement, namely in the area of the narrow groove, the second centering devices 20 allow a smaller play of movement than the first centering devices 14.

It may further be provided that, when raising the scraper blade 10, the second centering devices 20 reach the engagement position with the smaller play of movement first.

The described scraper device 6 can, in the same manner, also be used in a rear-loading milling machine.

To do so, the scraper blade 10 need only be provided with the corresponding cut-outs or outlet openings.

Embodiments can be seen from DE 102 47 579.

Lastly, the scraper device 6 can also be combined with the scraper device described in DE 102 47 579.

Although a preferred embodiment of the invention has been specifically illustrated and described herein, it is to be understood that minor variations may be made in the apparatus without departing from the spirit and scope of the invention, as defined by the appended claims.

What is claimed is:

1. Scraper device for a milling drum (2) mounted in a construction machine, with a scraper blade (10) arranged in a height-adjustable manner behind the milling drum (2) when seen in the direction of travel, which can glide on the surface (3) milled or to be milled by the milling drum (2), wherein the scraper blade (10) is guided in lateral guides (12) in a height-adjustable manner relative to the milling drum (2), and wherein first centering devices (14) are provided which center the scraper blade (10) with small lateral play of movement between the guides (12) when in a raised position, and which allow a greater lateral play of movement of the scraper blade (10) when the scraper blade (10) is in a lowered working position, characterized in that, second centering devices (20) act upon the upper end (16) of the scraper blade (10), restricting the lateral displacement of the scraper blade (10) at the upper end (16) in case of a lateral movement of the scraper blade (10) in the guides (12).

2. Scraper device in accordance with claim 1, characterized in that the second centering devices (20) show a groove (22) which runs parallel to the guides (12) as well as an engagement element (24) which interacts with the groove (22).

3. Scraper device in accordance with claim 1, characterized in that the second centering devices (20) consist of an engagement element (24) that projects from the scraper blade (10) and engages with a groove (22) which runs parallel to the guides (12).

4. Scraper device in accordance with claim 2, characterized in that the play between the groove (22) and the engagement element (24) increases towards the lower end (26) of the groove (22).

5. Scraper device in accordance with claim 2, characterized in that the engagement element (24) engages with a widened groove (22) when the scraper blade (10) is in the lowered working position.

6. Scraper device in accordance with claim 1, characterized in that the second centering devices (20) are arranged in the central axis (30) of the scraper blade (10), which runs parallel to the guides (12), or at a parallel distance to the same.

7. Scraper device in accordance with claim 1, characterized in that the second centering devices (20) consist of several elements, and that one element (24) of the second centering devices (20) is arranged on a projection (34) that projects upwards from the scraper blade (10).

8. Scraper device in accordance with claim 2, characterized in that the second centering devices (20) show a sliding block as engagement element (24) which is attached to the upper end (16) of the scraper blade (10) and is guided inside the groove (22).

9. Scraper device in accordance with claim 1, characterized in that the distance between the element (24) of the second centering devices (20), which is arranged at the scraper blade (10), and the first centering devices (14) as measured in the direction of the guides (12) is more than 50% of the length of the scraper blade (10) in height to maximum the length of the scraper blade (10) less 50% of the maximum milling depth of the milling drum (2).

10. Scraper device in accordance with claim 1, characterized in that the first centering devices (14) consist of cams (18) which reduce the play between the scraper blade (10) and the lateral guides (12) and are arranged at a distance from the lower edge (17) of the scraper blade (10).

11. Scraper device in accordance with claim 10, characterized in that the distance of the cams (18) arranged at the scraper blade (10) from the lower edge (17) of the scraper blade (10) is smaller than the maximum milling depth of the milling drum (2).

12. Scraper device in accordance with claim 8, characterized in that the sliding block as engagement element (24) shows rounded lateral surfaces that interact with the groove walls of the groove (22).

13. Scraper device in accordance with claim 8, characterized in that the sliding block as engagement element (24) shows diagonal guide surfaces (28) on its top side, which interact with the groove walls of the groove (22).

14. Scraper device in accordance with claim 1, characterized in that the second centering devices (20), when in the engagement position with the smaller play of movement, allow a smaller play of movement than the first centering devices (14).

15. Scraper device in accordance with claim 1, characterized in that, when the scraper blade (10) is raised, the second centering devices (20) reach the engagement position with the smaller play of movement first.

16. Scraper device in accordance with claim 2, characterized in that the second centering devices (20) consist of an engagement element (24) that projects from the scraper blade (10) and engages with a groove (22) which runs parallel to the guides (12).

17. Scraper device in accordance with claim 3, characterized in that the play between the groove (22) and the engagement element (24) increases towards the lower end (26) of the groove (22).

* * * * *